US008007378B2

(12) United States Patent
Vallon et al.

(10) Patent No.: US 8,007,378 B2
(45) Date of Patent: Aug. 30, 2011

(54) PING-PONG TABLE/LOCKING WITH AN INDEXING FINGER

(75) Inventors: Guillaume Vallon, Roubaix (FR); Cédric Mollet, Bondues (FR)

(73) Assignee: Decathlon, Villeneuve D'Ascq (FR)

( * ) Notice: Subject to any disclaimer, the term of this patent is extended or adjusted under 35 U.S.C. 154(b) by 296 days.

(21) Appl. No.: 12/219,071

(22) Filed: Jul. 15, 2008

(65) Prior Publication Data

US 2009/0029809 A1 Jan. 29, 2009

(30) Foreign Application Priority Data

Jul. 26, 2007 (FR) ..... 07 56735

(51) Int. Cl.
*A63B 67/04* (2006.01)

(52) U.S. Cl. ..... 473/496

(58) Field of Classification Search ..... 473/495, 473/496, 497; 108/169, 170; 52/7
See application file for complete search history.

(56) References Cited

U.S. PATENT DOCUMENTS

| | | | | |
|---|---|---|---|---|
| 2,569,007 | A * | 9/1951 | Klyce | 108/170 |
| 2,978,754 | A * | 4/1961 | Wilson | 108/170 |
| 3,476,061 | A * | 11/1969 | Takahashi | 108/169 |
| 3,557,720 | A * | 1/1971 | Blink et al. | 108/169 |
| 4,779,542 | A * | 10/1988 | Staten et al. | 108/170 |
| 6,223,661 | B1 * | 5/2001 | Griepentrog | 108/169 |
| 2004/0216649 | A1 * | 11/2004 | Kettler et al. | 108/170 |
| 2005/0284343 | A1 * | 12/2005 | Kettler et al. | 108/170 |
| 2009/0000522 | A1 * | 1/2009 | Collins et al. | 108/12 |

FOREIGN PATENT DOCUMENTS

| | | |
|---|---|---|
| DE | 201 09 549 U1 | 10/2002 |
| FR | 2 729 302 A | 7/1996 |
| WO | WO 01/89346 A | 11/2001 |

* cited by examiner

*Primary Examiner* — Gene Kim
*Assistant Examiner* — M Chambers
(74) *Attorney, Agent, or Firm* — Kenyon & Kenyon LLP

(57) ABSTRACT

The invention relates to a folding ping-pong table including a support, two flat boards mounted on the support and mobile between a raised position and a lowered position, the support including a central structure and, for each flat board, two legs positioned at each end of the flat board relatively to the central structure and two braces connecting both legs to the central structure, as well as locking means and remote actuation means for simultaneous control of the locking means of a same flat board. Said table is characterized in that, for each flat board, the locking means are positioned so as to allow direct blocking of the angular position between a leg and the corresponding brace, in the raised position and in the lowered position.

9 Claims, 5 Drawing Sheets

PING-PONG TABLE/LOCKING WITH AN INDEXING FINGER

This application claims priority to French Patent Application No. 07/56735 filed 26 Jul. 2007, the content of which is incorporated herein by reference.

FIELD OF THE INVENTION

The invention relates to the field of ping-pong tables and more particularly to foldable ping-pong tables.

By foldable ping-pong table is meant a ping-pong table comprising a support and two flat boards mobile relatively to the support between a horizontal position for playing and a vertical position so as to reduce the space occupied by the table and also to facilitate transport of the table which is generally mounted on casters.

BACKGROUND OF THE INVENTION

Systems for locking the mobile flat boards in the two positions, i.e. in the vertical position and in the horizontal position, so as to notably prevent any accidental tilting of the flat boards, have been proposed on the market for a long time.

For instance, tables equipped with hooks with which the flat boards may be blocked in the vertical position are known, the hook being positioned along a pivot connection so as to be able to be displaced by the user in order to release the flat board or to lock it when it is moved up.

This type of device has the advantage of simplicity; however, the flat board cannot be blocked in the horizontal position, which is detrimental to the stability of the table, notably during phases of the game and, on the other hand, the user who wishes to unlock the table is required to move right around the latter and to remove the hooks one by one.

Moreover, notably in French patent application FR 2 729 302, ping-pong tables are known, equipped with locking means positioned at the side portions of the table and consisting of a block in which a groove is made which allows the sliding of a finger positioned on the flat board, the finger may be locked in the low position allowing locking of the flat board positioned vertically.

These devices are not however satisfactory in the sense that they do not provide great stability at the end of the flat boards notably by taking into account the play existing between the leg and the brace which should be jointed so as to allow folding of the leg and on the other hand, these systems require that the user move on the side of the table so as to carry out unlocking while the upward motion of the flat board is easily performed by the hand of the latter.

SUMMARY OF THE INVENTION

The object of the present invention is to overcome the aforementioned drawbacks and to propose for this purpose a folding ping-pong table in which each flat board may be locked independently in the horizontal or lowered position, and in the vertical or raised position.

The object of the present invention is also to propose a folding ping-pong table in which locking and unlocking of each plat board are carried out by the user by a simple gesture, the latter being ideally positioned at the end of the flat board.

Another object of the present invention is to propose a folding ping-pong table in which means are provided for ensuring great stability of the table by providing an angular position between each leg and each brace both in the raised position and in the lowered position.

To do this, the present invention relates to a folding ping-pong table including a support, two flat boards mounted on a support and mobile between a raised position and a lowered position, the support including a central structure and, for each flat board, two legs positioned at each end of the flat board relatively to the central structure, and two braces connecting both legs to the central structure.

According to the invention, said folding ping-pong table for each flat board comprises locking means for directly blocking the angular position between a leg and the corresponding brace, in the raised position and in the lowered position, and remote actuation means providing simultaneous control of the locking means of a same flat board.

With this feature of the locking means, it is possible to provide great stability to the folding table, and more specifically to each flat board, whether the latter is in the raised position or in the lowered position corresponding to the game position.

With the remote actuation means combined with the aforementioned locking means, a single user positioned at the end of the flat board may reliably control and actuate the displacement of said flat board in order to lower it or raise it.

Advantageously, it is provided that the locking means comprise an indexing finger and a pivoting plate including at least two openings for receiving the indexing finger and which at least match in the lowered and raised position of the flat board, said plate being pivotably mounted on the leg and integral with the brace.

By using indexing fingers cooperating with a pivoting plate, accurate guiding of the displacement of each flat board and good resistance over time of the structure may be obtained as well as automatic locking in the low and high position of the indexing finger in the openings.

According to an advantageous feature of the invention, the plate includes a third opening corresponding to an intermediate position of the flat board.

With this feature, it is notably possible to avoid a sudden fall of the flat board if the user did not manage to properly control the downward motion of the flat board and therefore it is possible to avoid an impact of the leg on the ground which may generate deformation of the upper portion of the flat board and therefore of the game surface.

According to an advantageous feature of the invention, the remote actuation means are located on the crossbar connecting both legs located on a same side of the flat board.

With this feature, it is possible to unlock the flat board while one is positioned at the end of the latter, i.e. allow unlocking while the user is in the most favourable position for lifting or lowering the flat board.

According to another advantageous feature of the invention, the actuation means comprise an actuation handle linked to a fixed return component at the ends of the indexing fingers of the leg and the actuation of which causes the indexing fingers to retract from the openings of the pivoting plate.

With this feature, it is possible to facilitate the unlocking operation which is carried out by simply pulling on the actuation handle and, therefore, by a simple gesture.

BRIEF DESCRIPTION OF THE DRAWINGS

The present invention will be better understood upon reading the description which will be made hereafter of a preferred embodiment wherein the description is only given as a non-limiting example and with reference to the appended drawings wherein.

DETAILED DESCRIPTION

Figure 1:
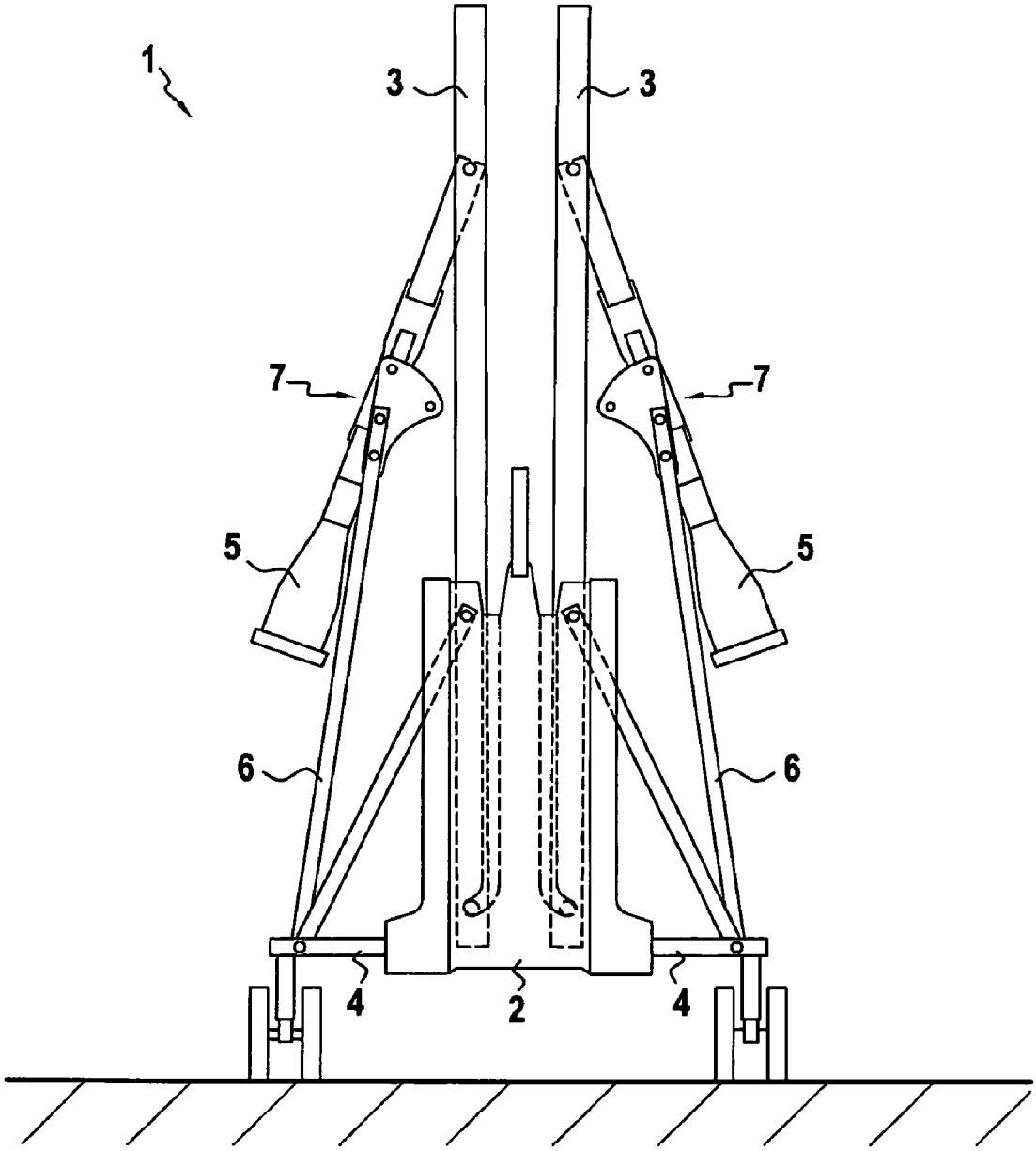
FIGS. 1 and 2 illustrate a schematic side view of a ping-pong table made according to the present invention, the flat board being positioned in the raised position in FIG. 1 and in the lowered position in FIG. 2.
Figure 2:
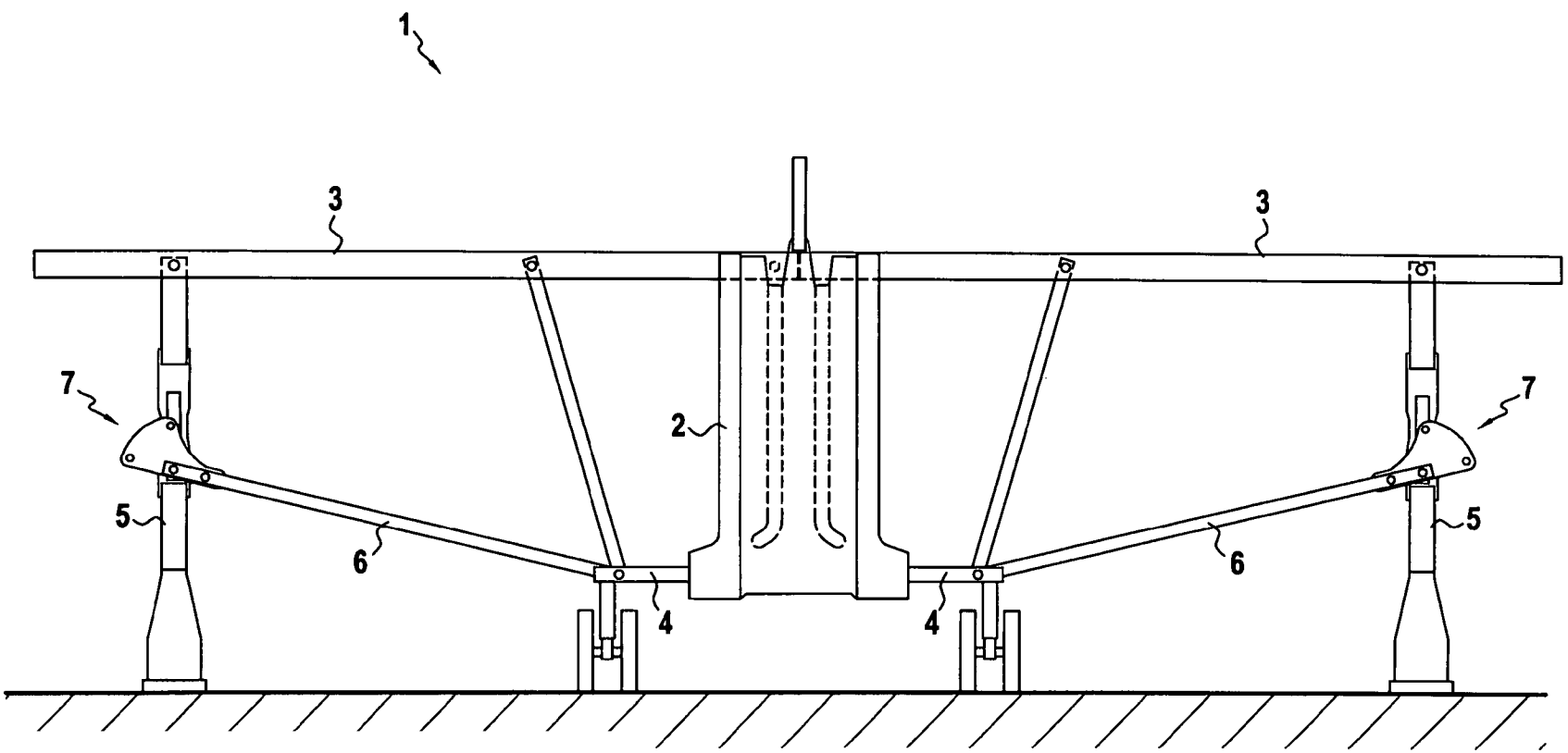

While mainly referring to FIGS. 1 and 2, a folding ping-pong table 1 is seen, including a support 2 and two flat boards 3.

The flat boards 3 are mobile between two positions, i.e. a raised position illustrated in FIG. 1 where the flat board is positioned vertically and a lowered position illustrated in FIG. 2 where the flat board is positioned horizontally.

The support 2 comprises a central structure 4, two flat boards 3 mounted on the support 2, and for each flat board 3, two legs 5 positioned at each end of the flat board 3 relatively to the central structure 2, and two braces 6 connecting both legs 5 to the central structure 2.

Figure 3:
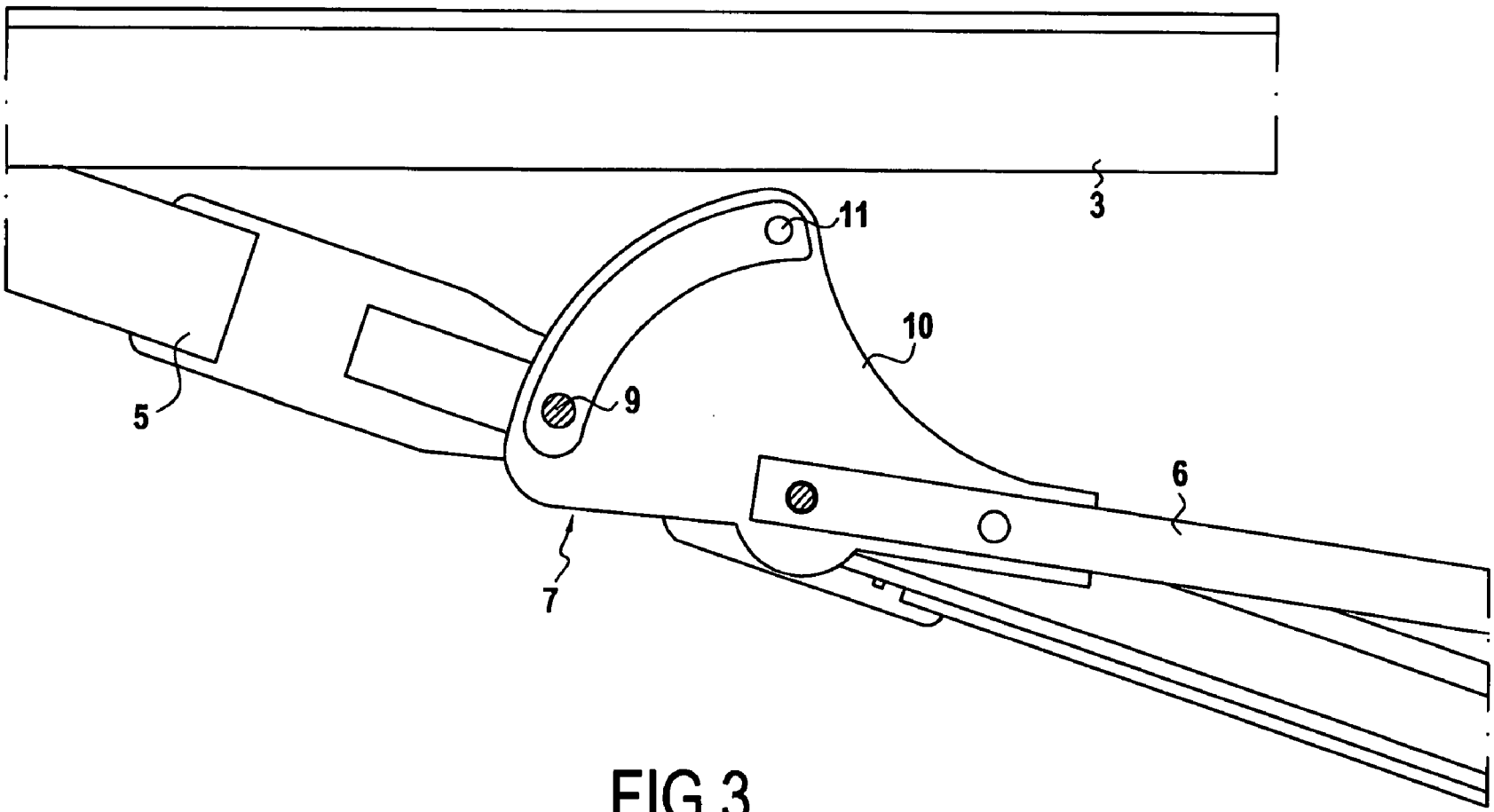
FIG. 3 illustrates an embodiment detail in a schematic and side view of the locking means according to the invention.

While referring this time more particularly to FIG. 3, it is seen that the folding ping-pong table 1 further includes locking means 7 so that for each flat board, the angular position between each leg 5 and the corresponding brace 6 may be blocked directly.

Figure 5:
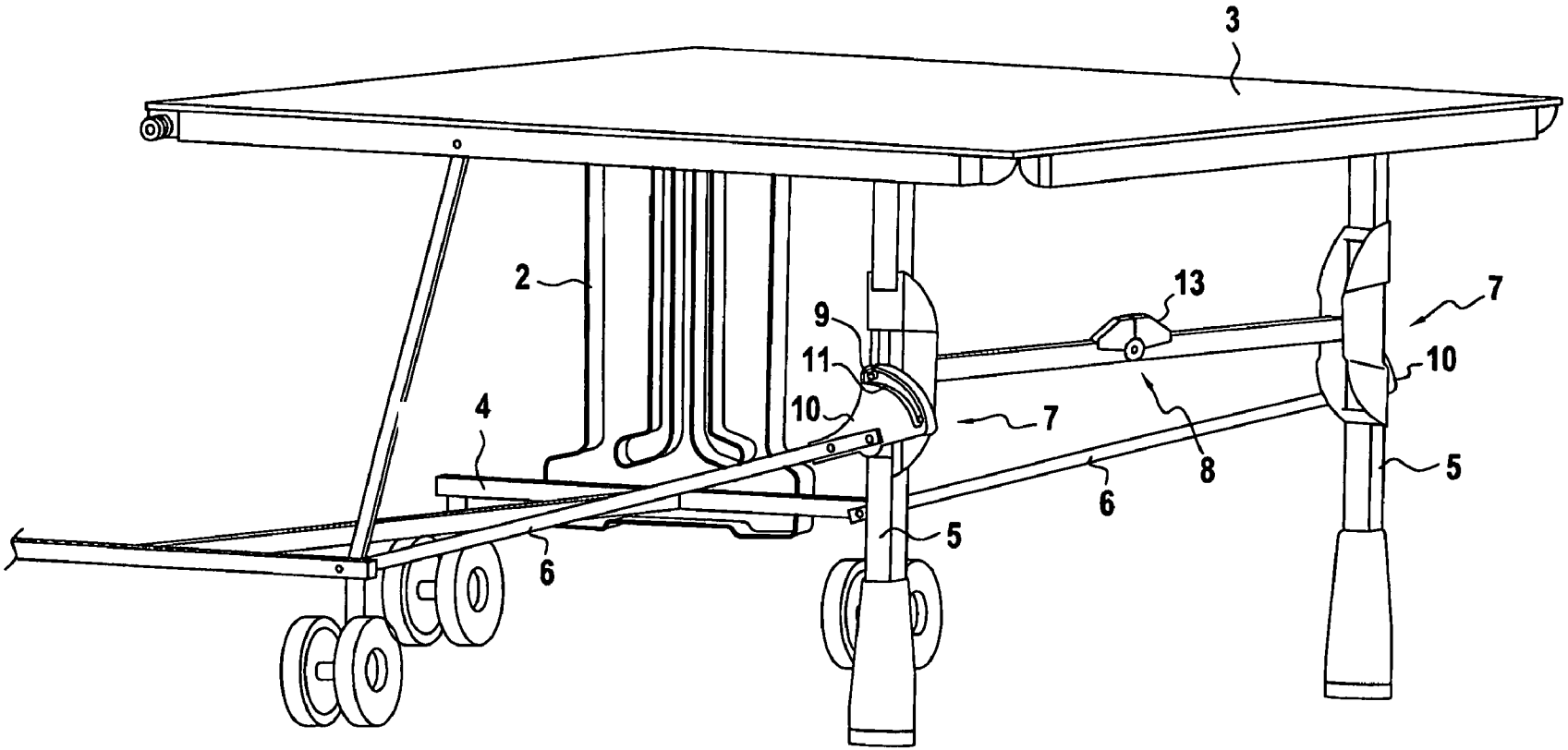
FIG. 5 shows a schematic perspective view of an exemplary embodiment of a folding table half according to the invention.

While referring to FIG. 5, an illustration of remote actuation means 8 for simultaneous control of the locking means 7 of a flat board is seen.

Referring back to FIG. 3, an exemplary embodiment of locking means 7 is seen, which advantageously comprise an indexing finger 9 cooperating with a pivoting plate 10, this plate being attached to the end of the brace 6.

It should also be noted that the plate 10 is advantageously pivotably mounted on the leg 5 integral with the brace 6.

However, in another embodiment, with another plate shape 10, it may be devised that the latter be fixed on the leg 5 and rotationally mobile on the brace 6.

The pivoting plate 10 includes two openings 11 for receiving the indexing finger 9 and therefore allowing it to be directly blocked in a given angular position between the leg 5 and the corresponding brace 6.

In the example of the figures, both openings 11 correspond to the lowered and raised positions of the flat board 3.

However, in other embodiments, it may also be provided that this plate 10 includes an intermediate opening and also corresponding to an intermediate position of the flat board 3 so as to block the latter in a mean angular position between the vertical position and the horizontal position.

Figure 4:
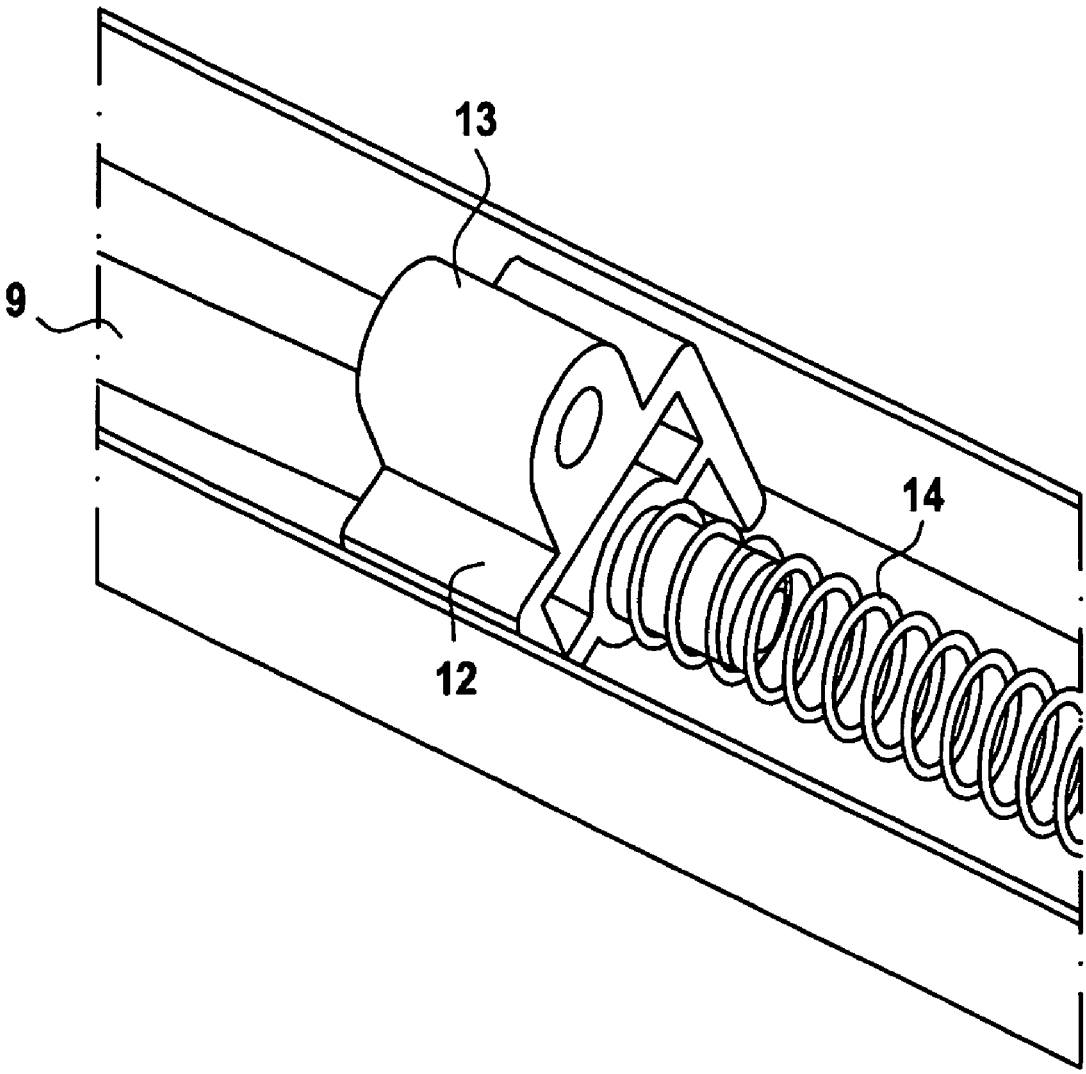
FIG. 4 illustrates in a perspective view a second embodiment detail according to the invention.

Referring this time to FIG. 4, an embodiment of the remote control means 8 is seen.

These means 8 are advantageously positioned at the crossbar 12 connecting the legs 5 located at a same flat board 3.

These actuation means 8 will notably advantageously be integrated to the crossbar for guiding and stiffness reasons; however, an embodiment may also be devised in which these means 8 would be positioned close to the crossbar or even positioned on the upper portion of the crossbar 12.

Advantageously, the actuation means 8 include an actuation handle 13 connected to a return component 14, the handle 13 being further fixed to the ends of the indexing finger 9 of each leg 5 so that actuation of the handle 13 causes the indexing fingers 9 to retract out from of the openings 11 made in the pivoting plate 10.

Advantageously, the return component 14 is linked to the ends of the indexing fingers 9 via clamping clips.

As illustrated in FIG. 4, the return component 14 will advantageously be formed with a spring and notably a spring with non-joined spires.

The operation of the thereby described device is the following:

- when the flat board 3 is in a vertical position as illustrated in FIG. 1, the user will apply traction on the handle 13 which has the effect of extracting the indexing fingers 9 from the upper openings of the plate 10 and as unlocking is achieved, allows the flat board 3 to move down,
- when the flat board 3 arrives in the low position, the indexing finger 9 enters the second opening 11 made in the plate 10 and will be locked; the table 1 is therefore also locked in the game position and is particularly stable in this position since the angular position between each leg 5 and each brace 6 is fixed in spite of the joint existing between both components 5, 6.

In order to carry out unlocking of the table 1 in order to raise it, the user should, following the example of the downward motion of the flat board, pull on the handle 13, which has the effect of extracting the indexing fingers 9 out of the openings 11 of the plate 10, and, once the unlocking is achieved, the user may then raise the flat board 3 until he/she places it in the position illustrated in FIG. 1 in which the indexing fingers 9 fit into the upper openings 11.

On this matter, the indexing fingers 9 advantageously consist of a rod positioned in the crossbar 12 connecting the legs 5 on a same side of the flat board 3 and translational guiding is also provided by at least one slider not shown in the appended drawings with which these indexing fingers 9 may be guided into and out of the openings 11.

Consequently, the device which equips the ping-pong table 1, as described above, provides easy and reliable locking and unlocking of the flat board 3, further providing great stability to the table 1 in the lowered or raised position.

Of course, other features within the reach of one skilled in the art might also have been contemplated without however departing from the scope of the invention as defined by the claims hereafter.

The invention claimed is:

1. A folding ping-pong table including a support, two flat boards mounted on the support and mobile between a raised position and a lowered position, the support including a central structure and, for each flat board, two legs positioned at each end of the flat board relatively to the central structure and two braces connecting both legs to the central structure, as well as a locking device and a remote actuation device providing simultaneous control of the locking device of a same flat board, wherein, for each flat board, the locking device is positioned so as to allow direct blocking of the angular position between the leg and the corresponding brace, in the raised position and in the lowered position.

2. The folding ping-pong table according to claim 1, wherein the locking device comprises an indexing finger and a pivoting plate including two openings for receiving the indexing finger and corresponding to the lowered and raised positions of the flat board, said plate being pivotably mounted on the leg and integral with the brace.

3. The folding ping-pong table according to claim 2, wherein the plate includes a third opening corresponding to an intermediate position of the flat board.

4. The folding ping-pong table according to claim 1, wherein the remote actuation device is located on the crossbar connecting both legs of a same flat board.

5. The folding ping-pong table according to claim 2, wherein the actuation comprises an actuation handle connected to a return component attached on the ends of the indexing fingers of a flat board and the actuation of which causes the indexing fingers to be retracted from the openings of the pivoting plate.

6. The folding ping-pong table according to claim 5, wherein the return component consists of a spring.

7. The folding ping-pong table according to claim 5, wherein the return component is connected to the ends of the indexing fingers via clamping clips.

8. The folding ping-pong table according to claim 5, wherein each indexing finger is positioned in the crossbar connecting the legs on a same side and is guided in translation by at least one slider.

9. The folding ping-pong table according to claim 5, wherein pulling on the actuation handle generates compression of the return component causing the indexing fingers to be retracted out of the openings of the plates of a flat board.

* * * * *